United States Patent [19]

Midana

[11] 4,114,889

[45] Sep. 19, 1978

[54] GOLF GAME APPARATUS

[76] Inventor: Fiorenzo Midana, Corso Giovanni Agnelli 48, Turin, Italy

[21] Appl. No.: 786,100

[22] Filed: Apr. 11, 1977

[30] Foreign Application Priority Data

Mar. 2, 1977 [IT] Italy ..... 52972/77[U]

[51] Int. Cl.[2] ..... A63B 69/36

[52] U.S. Cl. ..... 273/176 F; 273/177 R; 273/186 C; 273/187 A; 46/DIG. 1

[58] Field of Search ..... 273/177 R, 177 A, 177 B, 273/176 F, 186 R, 186 C, 187 A, 176 FA, 176 FB

[56] References Cited

U.S. PATENT DOCUMENTS 898,530 9/1908 Treadwell ..... 273/177 A 3,722,889 3/1973 Miller ..... 273/176 F 4,017,084 4/1977 Jeffery ..... 273/177 R X

*Primary Examiner*—George J. Marlo

[57] ABSTRACT

Each end of a golf ball putting carpet includes a series of longitudinally extending alignment stripes on the upper putting surface thereof. A putting target simulating a conventional putting cup is selectively anchored to the carpet in close proximity to the stripes at one end of the carpet. A stance positioning device is selectively positioned at the other end of the carpet. The stance positioning member also includes at one end thereof a series of parallel reference lines which may be aligned with the adjacent stripes on the carpet and also enable a golfer to select a preferred golf club swing path while properly addressing a golf ball with respect to the putting target.

3 Claims, 4 Drawing Figures

GOLF GAME APPARATUS

This invention relates to a golf teaching device for golf playing exercises outside the golf course. The device can be used together with the "Didactic Device for Golf Playing Exercises" described in U.S. patent application Ser. No. 764,816, filed Feb. 2, 1977.

These two didactic devices, when used together, are particularly useful for learning the so-called putting, i.e. the technique of hitting the ball so that it will roll into the hole.

As explained in the specification of the above-mentioned application and as is also generally known, the golf game comprises, for each of the holes forming a course, an initial phase of approach in which one or more strokes are made on various ground, and the final putting phase which is played on smooth grassy ground, the so-called "green", where the hole is located. Therefore, at least half of the total number of strokes in a match are putting strokes and putting also involves the more difficult and ticklish strokes. This shows how important is to have a refined putting technique which mainly depends on a correct posture and alignment of the body of the player with the ball and how he performs the stroke.

It is therefore an object of the present invention to provide a golf teaching device which together with and in addition to the device described described in U.S. patent application Ser. No. 764,816 permits a player to carry out putting exercises and to make more correct putting strokes due to the provision of safe visible guides on a well defined area, even, for example, in closed rooms.

This object is achieved according to the invention by providing a golf teaching device which permits to carry out golf playing exercises outside the golf course together with the didactic device described in U.S. patent application Ser. No. 764,816 and which comprises a carpet carrying at least two aligned stripes located at a predetermined position from one another, and a target arranged on the carpet adjacent one of said stripes and formed by a thin plate having an upright edge along part of its periphery.

A preferred embodiment of the invention will now be described by way of example and with reference to the accompanying drawings, in which.

Figure 1:
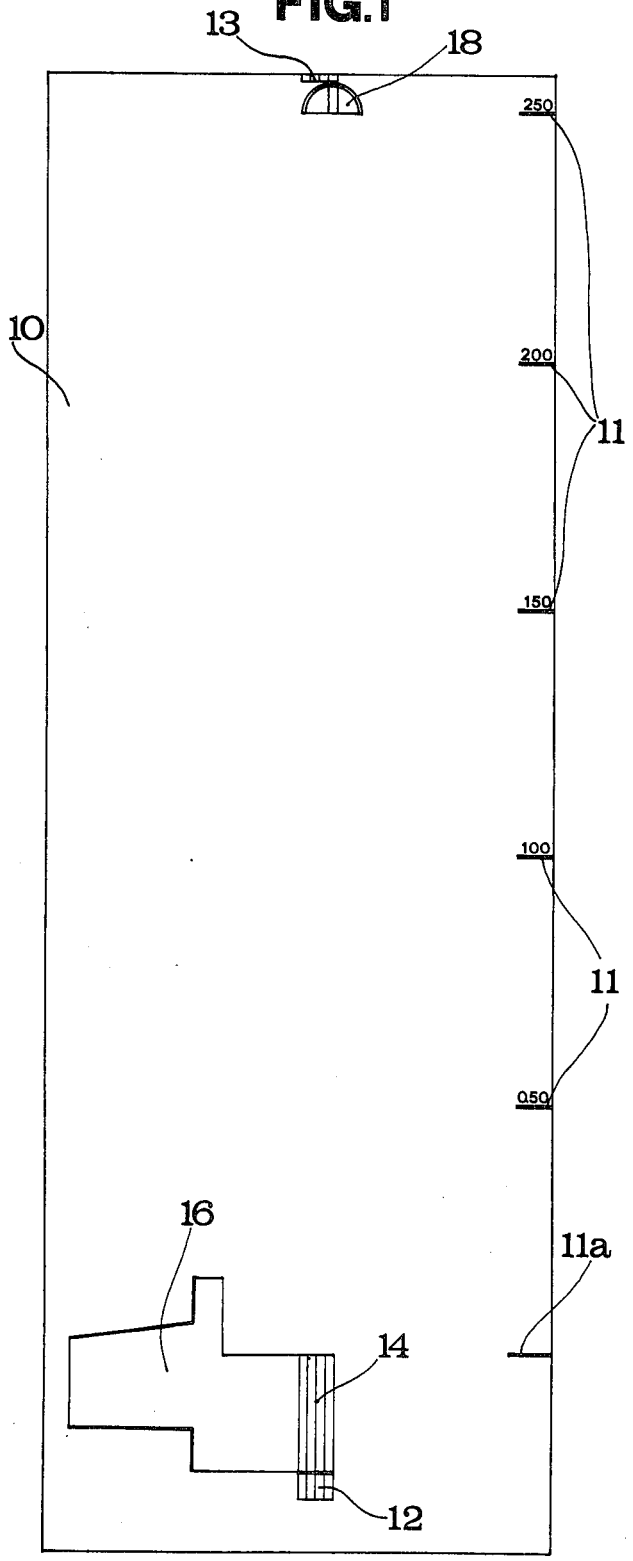
FIG. 1 is a top plan view of a carpet forming part of the golf teaching device according to the present invention.

FIG. 1 shows a rectangular carpet 10, preferably having a length of 307 cm and a width of about 100 cm, but these dimensions may vary within wide limits. Indicated on one of the longitudinal sides of the carpet 10 is a series of reference lines 11 which part from an initial zero reference 11*a* and are spaced by 50 cm from one another. Each reference line 11 is provided with a number indicating the distance from the initial reference line 11*a*.

At the two opposed ends along a longitudinal central line of the carpet the latter is provided with a series of stripes 12, 13 which may also be notches and preferably are coloured and aligned in pairs longitudinally of the carpet. The number and width, and possibly colour, of the coloured notches or stripes 12, 13 correspond to the reference stripes 14 on a didactic device 16 as described in the aforementioned U.S. patent application Ser. No. 764,816. These reference stripes or lines 14 are indicated by reference numeral 46 in said prior Patent Application. For a more detailed description of the configuration and operation of the didactic device 16 reference is made to said prior patent application.

The carpet 10 is preferably made of a trimmed moquette having a surface similar to that of a real outside golf green.

Figure 2:
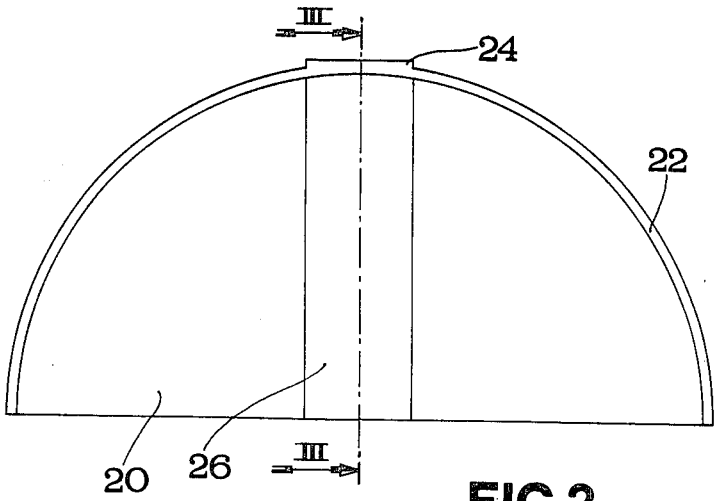
FIG. 2 is a top plan view, on an enlarged scale, of a target forming part of the golf teaching device according to the invention.
Figure 3:
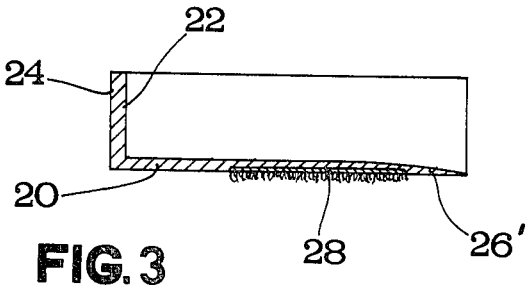
FIG. 3 is a longitudinal section, on an enlarged scale, of the target of FIG. 2, the section being taken along the line III—III in FIG. 2.
Figure 4:
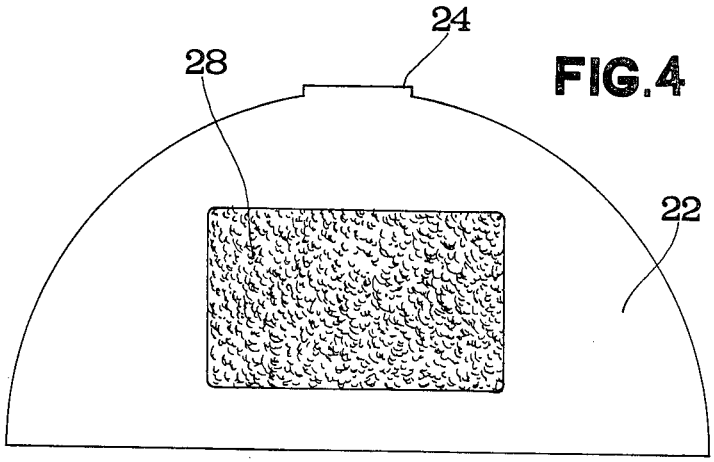
FIG. 4 is a bottom plan view of the target of FIG. 2, likewise on an enlarged scale.

Indicated by 18 in FIG. 1 is a target shown in greater detail on an enlarged scale in FIGS. 2, 3 and 4. As shown in these latter Figures, the target 18 comprises a semicircular plate 20 having a diameter of 108 mm corresponding to the diameter of a regular golf hole. Along its curved periphery the target 18 has an upright edge 22 provided in its centre with a flat projection 24 of a width corresponding to that of one of the stripes 13 on the carpet 10 to permit alignment of the projection 24 with one of the reference stripes 13. To facilitate such alignment, the upper surface of the semicircular plate 20 is provided with a coloured stripe 26 of a width corresponding to that of the projection 24. Along its straight side the plate 20 has a tapering portion 26' for purposes to be described hereinafter.

Finally, the underside of the plate 20 is provided with a recess for accommodating an adhesive tab 28 of the type known under the commercial name "Velcro" which, as known, is formed by a multiplicity of small hooks which adhere to surfaces such as that of the carpet 10. By means of this adhesive tab 28 the target 18 can be secured to the carpet 10 in the desired position and easily be removed therefrom. The semicircular plate 20 may be provided on its upper side with a central coloured stripe extending perpendicularly to the straight edge of the plate.

The height of the edge 22 of the plate 20 preferably is between 12 and 15 mm so that it will retain a golf ball arriving on the plate 20 only when the ball moves at a speed below a certain speed limit, as will be described hereinafter.

The carpet 10 and target 18 are used together with the didactic device 16 according to the aforementioned U.S. patent application Ser. No. 764,816 in the following manner:

After having placed the carpet 10 on a flat horizontal surface, the didactic device 16 is positioned thereon as described in said prior application, bringing the reference stripes 14 on the device 16 into alignment with the reference stripes 12 on the carpet and checking also that the stripes 14 are parallel to the longitudinal sides of the carpet. Then the target 18 is set in the position shown in FIG. 1, with the reference stripe 26 aligned with one of the reference stripes 13 on the carpet. This position corresponds to the desired position of the ball relative to the device 16 according to the criteria outlined in the specification of the above-mentioned prior application.

Then the ball is placed with respect to the device 16 also as described in said prior application and the ball is hit to make it roll towards the target 18. The tapering edge portion 26' of the plate 20 permits the ball to roll smoothly into the target and if the ball has been hit correctly with respect to direction and speed it will stop within the target. But if the speed is excessive although the direction is correct, i.e. when the speed of the ball is such that in real open-air playing it would not go into the hole, then the edge 22 will not be sufficient to retain the ball because of its high speed and the ball will jump over the edge to indicate to the player that it has been hit with too great force.

For a better understanding of the operation of the present device and the advantages obtained by the present invention reference may also be had to the specification of the aforementioned prior application.

Although a preferred embodiment of the invention has been described herein in detail it is to be understood that the present invention is not limited to this precise embodiment and that numerous changes and modifications obvious to one skilled in the art may be made therein without departing from the scope of the invention as defined by the following claims.

I claim:

1. A golf teaching device for use at a location remote from a golf course comprising in combination:

an elongated carpet having a first plurality of parallel spaced reference markings adjacent one end portion thereof and a second plurality of parallel spaced reference markings adjacent the other end portion thereof, the reference markings of said first and second plurality of markings being in longitudinal alignment;

a target device attachable releasably to said other end of said carpet for receiving a golf ball therein, said target device comprising a semi-circular plate having a straight downwardly inclined front edge, the arcuate periphery of said plate being defined by an upstanding wall engageable by and for stopping a golf ball entering the target device, said target device also including a rearwardly extending straightsided projection the sides of which are parallel and spaced apart a distance not greater than the spacing between adjacent ones of said second plurality of reference markings;

and a foot positioning member including a first section presenting a first pair of spaced edges engageable respectively by the insteps of a golfer's left and right feet and a second pair of edges extending substantially perpendicularly of at least one of said first pair of edges engageable by the toes of the golfer's feet, said foot positioning member having a second section including a plurality of parallel reference lines defining a series of golf club swing paths for selection by the golfer and alignable with corresponding ones of the reference markings of said first and second plurality of reference markings;

whereby a golfer may position said foot positioning member on said carpet in selected relation to said first plurality of reference markings, place a golf ball on one of the reference lines thereon, position the target device so as to be in correct selected alignment with said selected first and second reference markings and thereby properly address the ball with respect to the target device.

2. A golf teaching device as claimed in claim 1, wherein said plate of the target is provided with a central coloured stripe extending perpendicularly to the straight front edge thereof.

3. A golf teaching device as claimed in claim 1, wherein a scale is provided along one longitudinal edge of the carpet to indicate the distance of travel of the golf ball from the hitting position.

* * * * *